US007969076B2

(12) United States Patent
Liu et al.

(10) Patent No.: US 7,969,076 B2
(45) Date of Patent: Jun. 28, 2011

(54) LED LAMP AND ADJUSTABLE LAMP CAP THEREOF

(75) Inventors: Tay-Jian Liu, Tu-Cheng (TW); Tao-Ping Zhou, Shenzhen (CN); Guang-You Lu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 90 days.

(21) Appl. No.: 12/565,774

(22) Filed: Sep. 24, 2009

(65) Prior Publication Data

US 2010/0320891 A1 Dec. 23, 2010

(30) Foreign Application Priority Data

Jun. 18, 2009 (CN) ..... 2009 1 0303419

(51) Int. Cl.
*H01J 1/02* (2006.01)

(52) U.S. Cl. ..... 313/46; 313/318.01

(58) Field of Classification Search ..... 313/40, 313/45, 46, 49, 318.01, 318.02, 318.05, 318.09; 439/226, 230, 240
See application file for complete search history.

(56) References Cited

U.S. PATENT DOCUMENTS 2,295,883 A * 9/1942 Williams ..... 439/230
6,632,100 B1 * 10/2003 Richardson ..... 439/242
2009/0261706 A1 * 10/2009 Sorella et al. ..... 313/46

* cited by examiner

*Primary Examiner* — Vip Patel
(74) *Attorney, Agent, or Firm* — Frank R. Niranjan

(57) ABSTRACT

An LED lamp includes a cooling member, a light source, a lamp cover and a pair of lamp caps arranged at opposite ends of the cooling member. The cooling member has an elongated heat absorbing plate forming a heat absorbing surface at one outer side thereof. The light source includes a plurality of LEDs arranged on the heat absorbing surface. The lamp cover covers the LEDs therein and engages with the cooling member. Each lamp cap includes an end cap fixed on the cooling member and a connector rotatably connected with the end cap. The connector includes a pair of poles being electrically connected to the LEDs and extending outwardly therefrom for inserting into a lamp holder to get a power for the LEDs.

20 Claims, 17 Drawing Sheets

LED LAMP AND ADJUSTABLE LAMP CAP THEREOF

BACKGROUND

1. Technical Field

The disclosure generally relates to light emitting diode (LED) lamps, and particularly to an LED lamp with an adjustable lamp cap for facilitating assembly of the LED lamp to a lamp holder and facilitating adjustment of an illumination orientation of the LED lamp.

2. Description of Related Art

In recent years, LED lamps are preferred for use rather than CCFLs (cold cathode fluorescent lamps) and other light sources due to their excellent properties, including high brightness, energy saving, long lifespan, wide color range, and etc. Generally, a CCFL is elongated in profile and has a pair of electrically conductive poles provided at each of two ends of the CCFL. The conductive poles are inserted into a lamp holder, whereby the CCFL can get power through the lamp holder. Since the CCFL diffuses light outwardly from an outer surface thereof uniformly, the CCFL can be freely and easily mounted to the lamp holder without the need to adjust an illumination orientation of the CCFL. However, a light emitting surface of an LED is usually hemispherical and a beam angle of the LED is usually not larger than 120 degrees, which means the LED just can illuminate about two-thirds of a space in front of the LED emitting surface. Thus, an illumination orientation of the light emitting surface of the LED is very important to an LED lamp and should be accurately controlled. When the CCFL is substituted by the LED lamp and the LED lamp is mounted to the lamp holder which is originally used to mount the CCFL, an illumination orientation of the light emitting surface of the LED should be easily regulated to maintain the LED lamp to have a proper illumination orientation without bringing inconveniency for assembly the LED lamp to the lamp holder so that the LED lamp can be accurately and easily mounted to the lamp holder.

For the foregoing reasons, therefore, there is a need in the art for an LED lamp which overcomes the limitations described above.

DETAILED DESCRIPTION

Figure 1:
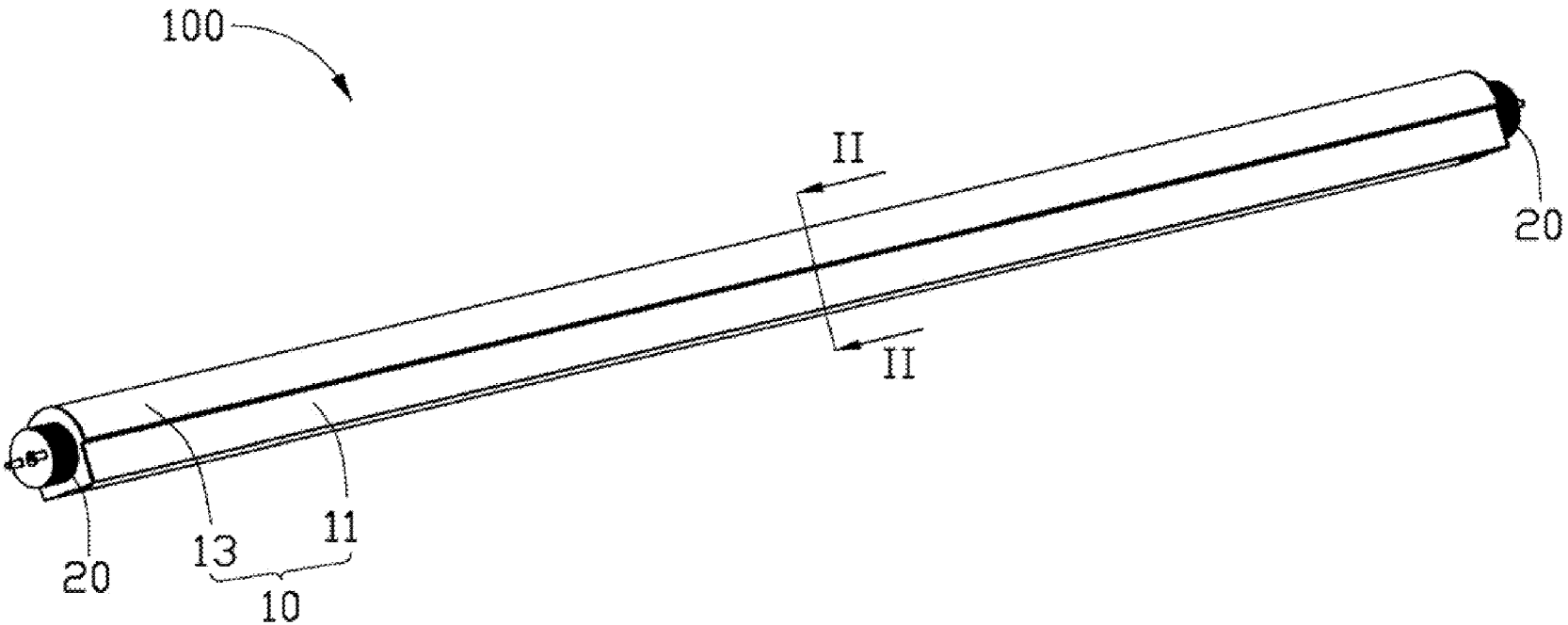
FIG. 1 is an assembled, isometric view of an LED lamp in accordance with a first embodiment.

Referring to FIG. 1, an LED lamp 100 according to a first embodiment includes an elongated lamp tube 10, and a pair of adjustable lamp caps 20 connected at two opposite longitudinal ends of the lamp tube 10, respectively.

Figure 2:
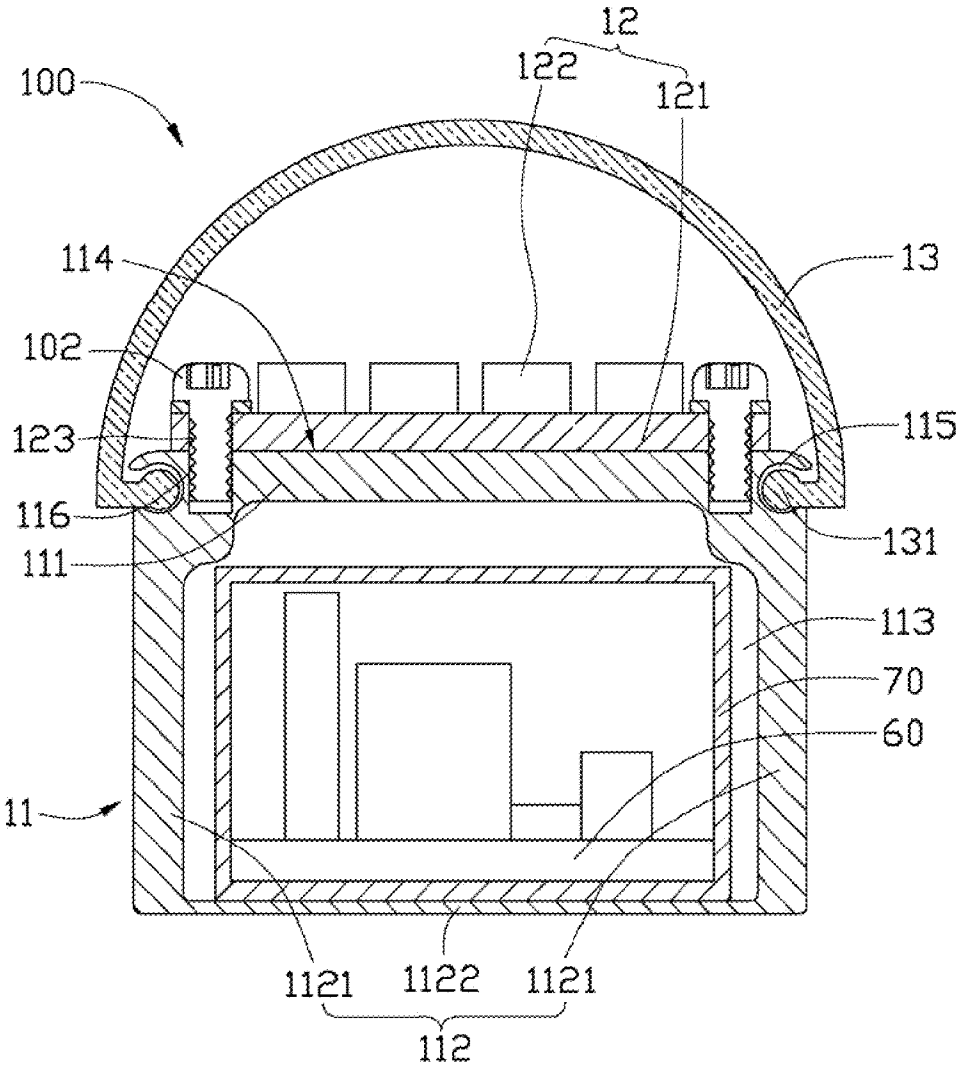
FIG. 2 is an enlarged, cross-sectional view of a lamp tube of the LED lamp of FIG. 1, taken along line II-II thereof.

Referring to FIG. 2, the lamp tube 10 includes a light source 12, a circuit board 60 connected with the light source 12 electrically, a cooling member 11 at a bottom side of the light source 12, and a lamp cover 13 at a top side of the light source 12. The light source 12 includes a substrate 121, and a plurality of LEDs 122 arranged on the substrate 121. The substrate 121 is elongated, and forms circuits and a plurality of electrodes thereon; the electrodes electrically connect with the circuits. The plurality of LEDs 122 are evenly spaced from each other, and are electrically connected to the circuits of the substrate 121. A plurality of through holes 123 are respectively defined in the substrate 121 near left and right lateral edges of the substrate 121.

The cooling member 11 is an elongated, hollow metal duct. A cross section of the cooling member 11 is substantially rectangular. An elongated rectangular chamber 113 is defined in the cooling member 11. The circuit board 60 is received in the chamber 113 of the cooling member 11, and is enclosed by a rectangular electrical insulator 70 which insulates the circuit board 60 from the cooling member 11. The circuit board 60 interconnects the LEDs 122 with the lamp caps 20, and provides drive power, control circuit and power management for the LEDs 122. Thus, after the lamp caps 20 of the LED lamp 100 are connected to a lamp holder, such as a traditional fluorescent lamp holder, electric current can be supplied to the LEDs 122 via the circuit board 60 to cause the LEDs 122 to generate light.

The cooling member 11 includes a heat absorbing plate 111 and a generally U-shaped heat dissipating plate 112 connecting with the heat absorbing plate 111. The heat absorbing plate 111 is an elongated sheet, and forms a flat heat absorbing surface 114 at a top side thereof. The substrate 121 of the light source 12 is arranged on the heat absorbing plate 111 and attached to the heat absorbing surface 114 closely, and heat generated by the LEDs 122 can be conducted to the cooling member 11 for dissipation via the substrate 121. The heat absorbing plate 111 defines two receiving grooves 115 respectively in left and right edges thereof for engaging with the lamp cover 13. A plurality of fixing holes 116 are defined in the heat absorbing plate 111 corresponding to the through holes 123 of the substrate 121.

A plurality of screws 102 respectively extend through the through holes 123 of the substrate 121 and threadedly engage into the fixing holes 116 of the heat absorbing plate 111, to thereby securely attach the substrate 121 to the heat absorbing surface 114 of the heat absorbing plate 111. An electrically insulating layer can be spread on each screw 102 to insulate the screw 102 from the circuits of the substrate 121. Further, a layer of thermal interface material (TIM) may be applied between the substrate 121 and the heat absorbing surface 114 of the heat absorbing plate 111 of the cooling member 11 to eliminate an air interstice therebetween, to thereby enhance a heat conduction efficiency between the LEDs 122 arranged on the substrate 121 and the heat absorbing plate 111 of the cooling member 11. Alternatively, the substrate 121 can be attached to the heat absorbing surface 114 fixedly and intimately through surface mount technology (SMT), whereby an interface between the substrate 121 and the heat absorbing plate 111 can be eliminated and a thermal resistance between the LEDs 122 and the heat absorbing plate 111 of the cooling member 11 is reduced.

The heat dissipating plate 112 includes two side walls 1121 and a connecting wall 1122. The two side walls 1121 extend vertically and downwardly from the left and right edges of the heat absorbing plate 111, respectively. The connecting wall 1122 interconnects bottom ends of the side walls 1121, and is parallel to the heat absorbing plate 111. In this embodiment, the heat absorbing plate 111 and the heat dissipating plate 112 of the cooling member 11 are integrally formed as a monolithic piece so as to reduce a thermal resistance therebetween. Alternatively, the heat dissipating plate 112 and the heat absorbing plate 111 of the cooling member 11 can be formed separately and then assembled together. The heat of the heat absorbing plate 111 absorbed from the LEDs 122 is finally dissipated to an ambient environment via the heat dissipating plate 112 which has a large heat exchanging area.

The lamp cover 13 is located above the LEDs 122, and assembled with the heat absorbing plate 111 of the cooling member 11. The lamp cover 13 functions as an optical lens for the LEDs 122, and guides light emitted by the LEDs 122 to the ambient environment. The lamp cover 13 is curved, and has a cross section being substantially C-shaped. A pair of protrusions 131 are respectively formed at left and right sides of the lamp cover 13 corresponding to the receiving grooves 115 of the heat absorbing plate 111. Each of the protrusions 131 extends inwardly from the lamp cover 13 into a corresponding receiving groove 115 of the heat absorbing plate 111 to assemble the lamp cover 13 onto the cooling member 11. Thus, the LEDs 122 are sealed between the lamp cover 13 and the cooling member 11, and are kept from environmental harm and mechanical damage.

Figure 3:
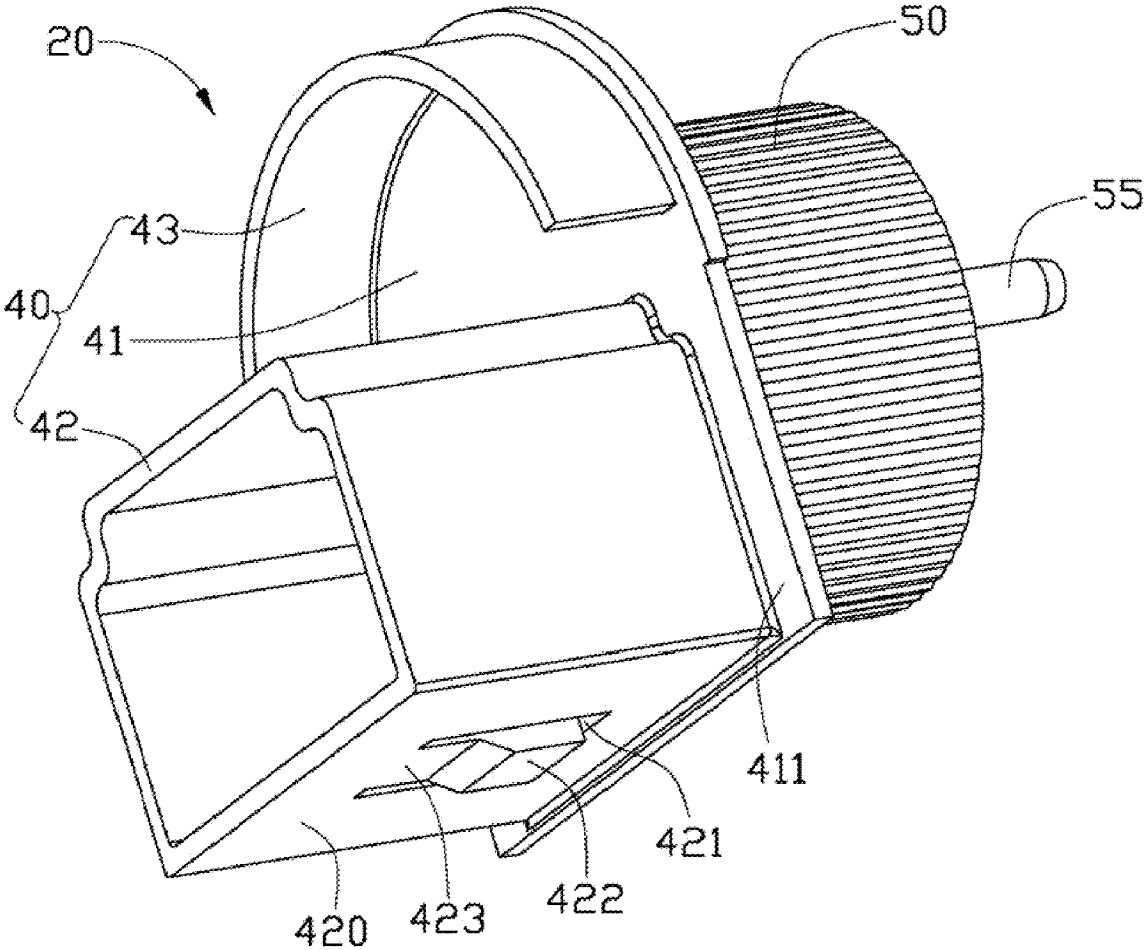
FIG. 3 is an isometric, assembled view of a lamp cap of the LED lamp of FIG. 1.

Referring to FIG. 3, the lamp caps 20 of the LED lamp 100 are identical to each other. Each lamp cap 20 includes an end cap 40 connected to one corresponding end of the lamp tube 10 and a connector 50 rotatably connected to the end cap 40.

Figure 4:
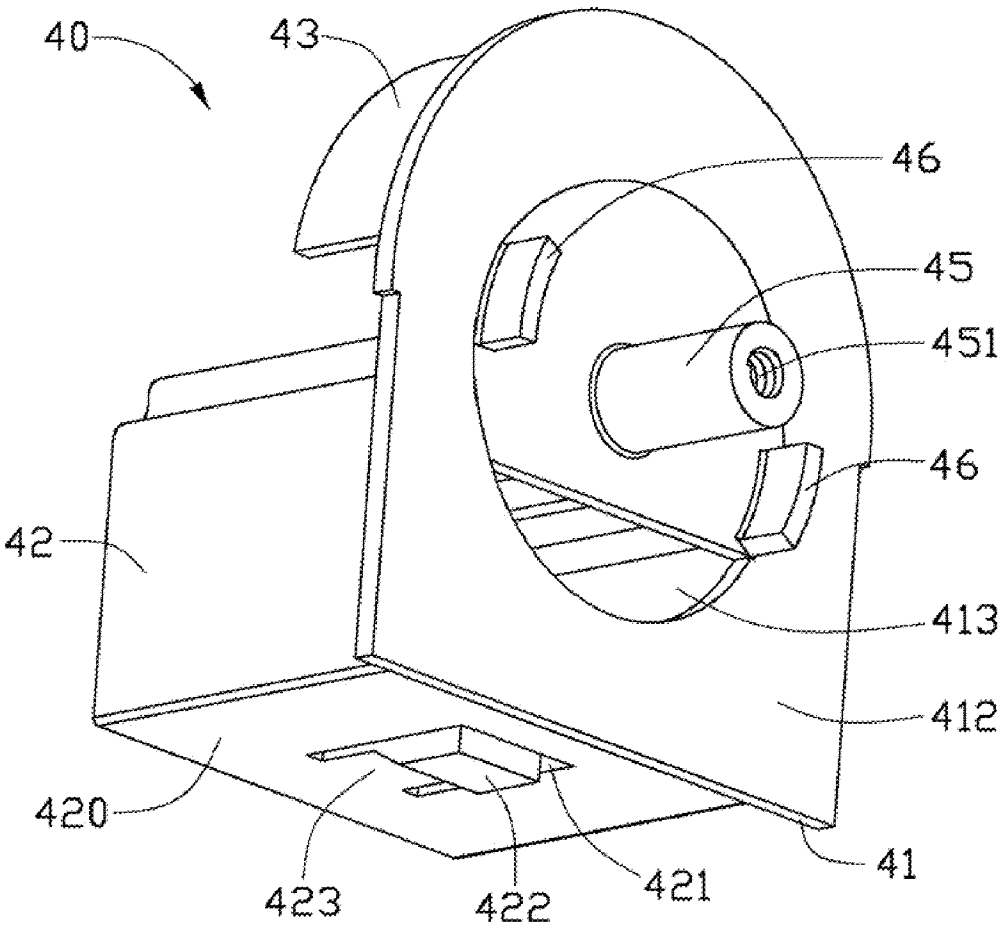
FIG. 4 shows an end cap of the lamp cap of FIG. 3, viewed from another aspect.

Referring to FIG. 4, the end cap 40 of each lamp cap 20 includes a vertically extended sealing plate 41. The sealing plate 41 has an inner surface 411 facing the lamp tube 10 and an opposite outer surface 412 facing the connector 50. The sealing plate 41 includes a lower portion and an upper portion. The lower portion of the sealing plate 41 has a shape corresponding to that of the cooling member 11, which is rectangular. The upper portion of the sealing plate 41 has a shape corresponding to that of the lamp cover 13, which is substantially semicircular. An aperture 413 is defined in the lower portion of the sealing plate 41. The aperture 413 extends through the sealing plate 41 from the inner surface 411 to the outer surface 412 for extension of wires therethrough to electrically connect the circuit board 60 with the connector 50.

A lower ear 42 and an upper ear 43 protrude perpendicularly from the lower portion and the upper portion of the inner surface 411 of the sealing plate 41 towards the lamp tube 10, respectively. The upper ear 43 is arc-shaped, whilst the lower ear 42 is substantially rectangular and hollow. A slot 421 is defined in a bottom board 420 of the lower ear 42. A tab 423 extends from the bottom board 420 into the slot 421. A nub 422 is formed at a bottom of the tab 423; the nub 422 is lower than a bottom surface of the bottom board 420 of the lower ear 42. The tab 423 with the nub 422 can move upwardly into the hollow lower ear 42 under an upward force acting thereon. The connecting wall 1122 of the cooling member 11 defines two cutouts (not shown) respectively near two ends thereof, in which the cutouts are located respectively corresponding to the two nubs 422 of the two lower ears 42 of the two lamp caps 20.

A pin 45 extends perpendicularly outwardly from a middle of the outer surface 412 of the sealing plate 41 towards the connector 50. The pin 45 is cylindrical-shaped with a threaded hole 451 defined therein. A pair of positioning blocks 46 are formed on the outer surface 412 of the sealing plate 41, and located around the pin 45. The two positioning blocks 46 are the same with each other; each block 46 is arc-shaped. The positioning blocks 46 are located on an imaginary circle which is co-center with the pin 45. The two positioning blocks 46 are symmetrically disposed on two opposite sides of the pin 45, so that an angle formed between the two positioning blocks 46 relative to the pin 45 is a little smaller than 180 degrees.

Figure 5:
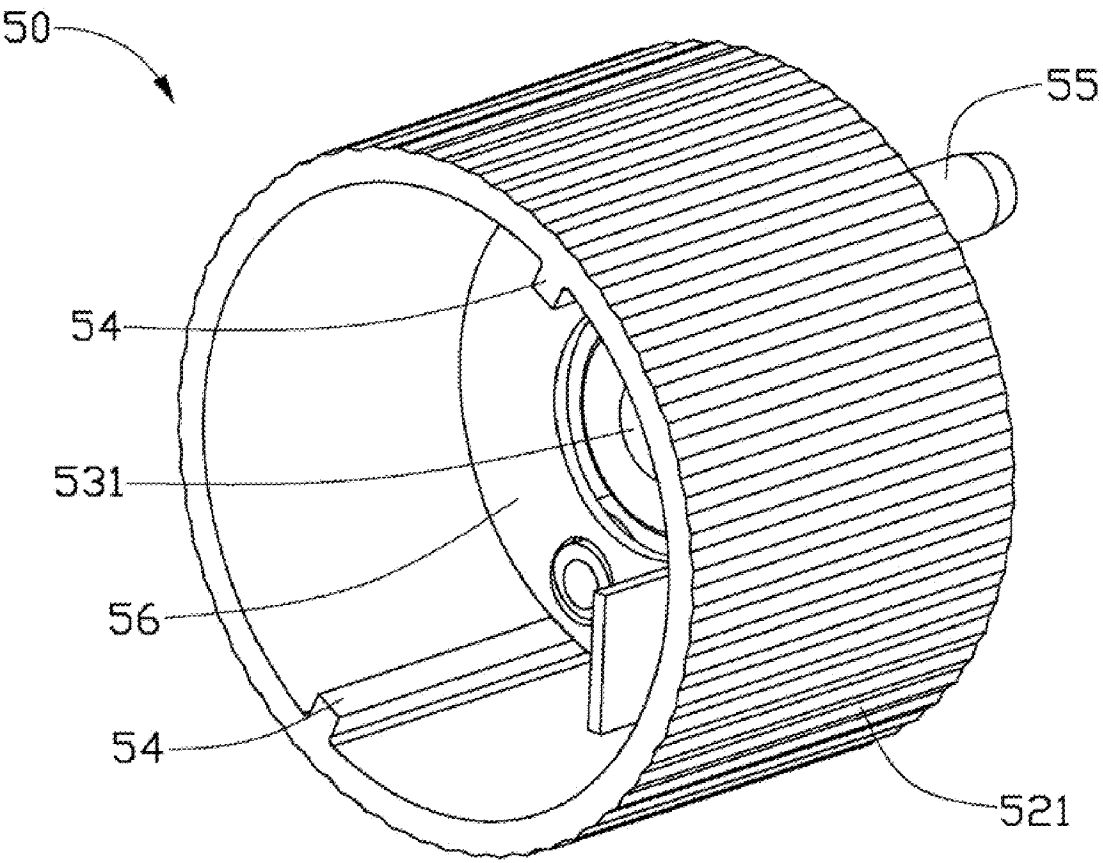
FIG. 5 shows a connector of the lamp cap of FIG. 3, viewed from another aspect.
Figure 6:
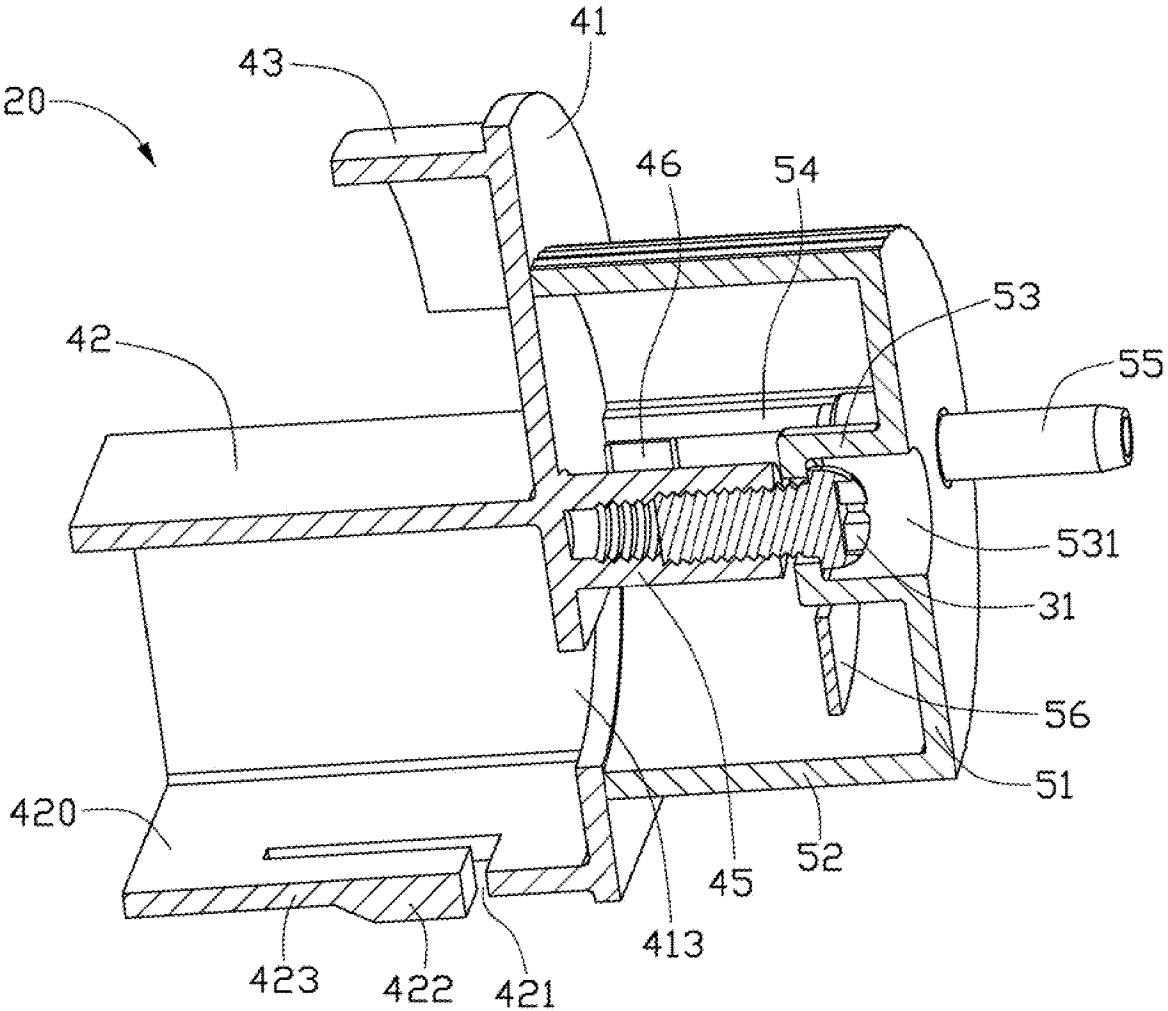
FIG. 6 is a cross-sectional view of the lamp cap of FIG. 3, taken along an axial direction thereof.

Referring to FIGS. 5 and 6, the connector 50 includes a circular base 51, a cylinder 52, a pair of poles 55 and a conductive ring 56. The cylinder 52 extends perpendicularly from an outer periphery of the base 51 to the outer surface 412 of the sealing plate 41 of the lamp cap 20. An inner diameter of the cylinder 52 is substantially the same as the diameter of the imaginary circle defined by the positioning blocks 46 of the lamp cap 20. A pair of latches 54 are formed on an inner circumferential surface of the cylinder 52. The two latches 54 are spaced from and parallel to each other. Each of the latches 54 extends inwardly from the inner circumferential surface of the cylinder 52 and is parallel to the axis of the cylinder 52. The two latches 54 are symmetric to a central axis of the cylinder 52. A plurality of teeth 521 are formed on an outer circumferential surface of the cylinder 52 for rotating of the cylinder 52 and positioning of the LED lamp 100.

A seat 53 extends from a central portion of the base 51 into the cylinder 52. A mounting hole 531 extends through the seat 53 with a diameter substantially equaling to that of the threaded hole 451 of the pin 45. A sum of lengths of the seat 53 and the pin 45 is not larger than that of the cylinder 52. The conductive ring 56 is arranged around the seat 53, and insulates from the seat 53. Each of the pair of poles 55 extends through the base 51 with an inner end thereof in the cylinder 52 connected to the conductive ring 56 electrically and an outer end thereof located out of the cylinder 52 for connecting to the lamp holder. The wires which electrically connect the circuit board 60 with the connector 50 are connected to the conductive ring 56 of the connector 50 for electrically connecting the LEDs 122 to the poles 55 via the circuit board 60 and the conductive ring 56.

Particularly referring to FIG. 6, when assembling the lamp cap 20, each of the connectors 50 is aligned with one corresponding end cap 40. The cylinder 52 of the connector 50 abuts the outer surface 412 of the end cap 40. The pin 45 and the positioning blocks 46 of each end cap 40 are received in the cylinder 52 of the corresponding connector 50. The latches 54 of the connector 50 are arranged between the positioning blocks 46, and are located on the imaginary circle. The latches 54 and the positioning blocks 46 are alternate along the imaginary circle. Then, a bolt 31 is brought to extend through the mounting hole 531 of each connector 50 and threadedly engages with the threaded hole 451 of the pin 45 of the corresponding end cap 40 to assemble the connector 50 and the end cap 40 together to form the lamp cap 20. Since the mounting hole 531 does not have threads formed therein, the bolt 31 in the mounting hole 531 of the connector 50 serves as a rotating axis for the connector 50 relative to the end cap 40. Thus, after the lamp cap 20 is assembled, the connector 50 can be rotated relative to the end cap 40 to cause the latches 54 of the connector 50 to rotate freely between the two positioning blocks 46 of the end cap 40 until the latches 54 of the connector 50 encounter the positioning blocks 46 of the end cap 40.

When the LED lamp 100 is assembled, the lamp caps 20 are arranged at opposite ends of the lamp tube 10, respectively. Then, the upper ear 43 and the lower ear 42 of each end cap 40 are pushed into the lamp cover 13 and the cooling member 11 of the lamp tube 10, respectively. Firstly, the lower ear 42 of each end cap 40 is pushed into the rectangular chamber 113 of the cooling member 11. The tab 423 of the lower ear 42 deforms when the nubs 422 encounter and engage into the cutouts of the connecting wall 1122. Then, the upper ear 43 of each end cap 40 slides into an inner surface of the lamp cover 13. Thus, the lamp caps 20 can not be taken apart from the lamp tube 10 for the engagement between the nubs 422 of the end caps 40 and the cutouts of the cooling member 11. Further, an outer periphery of the sealing plate 41 of each end cap 40 abuts the corresponding end of the lamp tube 10 to seal the corresponding end of the lamp tube 10.

When the present LED lamp 100 is mounted to the lamp holder, the poles 55 of the connectors 50 are inserted into the lamp holder, and thus the LEDs 122 of the LED lamp 100 can get power from an external power source via the lamp holder. In the present LED lamp 100, the connectors 50 and the end caps 40 are rotatably connected. During assembly of the LED lamp 100, the lamp tube 10 together with the end caps 40 can be easily rotated relative to the connectors 50 to obtain a proper illumination orientation for the LED lamp 100 in advance, and then the poles 55 of the connector 50 are manipulated to insert into the lamp holder. Alternatively, the poles 55 of the connector 50 can be manipulated to insert into the lamp holder in advance, and then the lamp tube 10 together with the end caps 40 are rotated relative to the connectors 50 to obtain a proper illumination orientation for the LED lamp 100. In the present LED lamp 100, the connectors 50 can be freely rotated in a range of less than 180 degrees relative to the lamp tube 10 to obtain a required illumination orientation for the lamp tube 10 without bringing inconveniency for assembly the LED lamp 100 to the lamp holder so that the LED lamp 100 can be accurately and easily mounted to the lamp holder. Particularly, when the lamp tube 10 is rotated to a position in which the positioning blocks 46 of the end caps 40 abut the latches 54 of the connectors 50, the LEDs 122 of the light source 12 are located at a horizontal level, and a light emitting surface of each LED 122 faces the ground directly under the LED lamp 100. The LED lamp 100 thus can be turned to a required illuminating orientation, and a utilization efficiency of the light of the LED lamp 100 is enhanced. In addition, since the connectors 50 of the present LED lamp 100 can be controlled to rotate relative to the lamp tube 10, assembly of the LED lamp 100 to the lamp holders is easy and convenient. Furthermore, since the connectors 50 are limited to rotate relative to the lamp tube 10 in a range of less than 180 degrees, the wires which electrically connect the circuit board 60 with the connector 50 are prevented from twisting off as a result of rotation more than 180 degrees.

Figure 7:
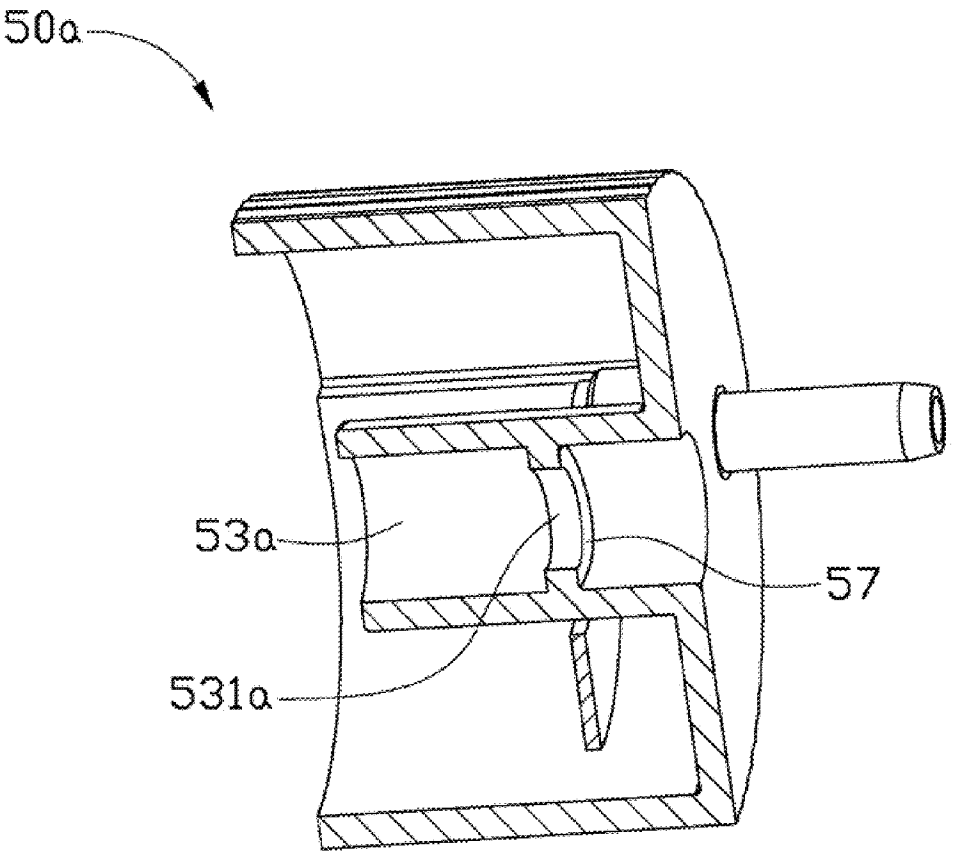
FIG. 7 is a cross-sectional view of a connector of the lamp cap of the LED lamp according to a second embodiment.

FIG. 7 shows an alternative connector 50*a* which can replace the connector 50 of the previous embodiment to form an alternative lamp cap. The difference between this connector 50*a* and the previous connector 50 only lies in the seat 53*a*. In this embodiment, the seat 53*a* has an inner diameter not smaller than an outer diameter of the pin 45, and has a length in an axial direction only slightly shorter than that of the cylinder 52. A step 57 is formed in the seat 53*a* with a mounting hole 531*a* extending therethrough. When the connector 50*a* is assembled with the end cap 40, the pin 45 is received in the seat 53*a*. Accordingly, the bolt 31 can extend through the mounting hole 531*a* and threadedly engage into the pin 45 to rotatably connect the end cap 40 and the connector 50*a* together. Since the seat 53*a* has a length greater than the previous seat 53, the seat 53*a* can surround an outer circumference of the pin 45 so that the connector 50*a* is more steadily connected to the end cap 40.

Figure 8:
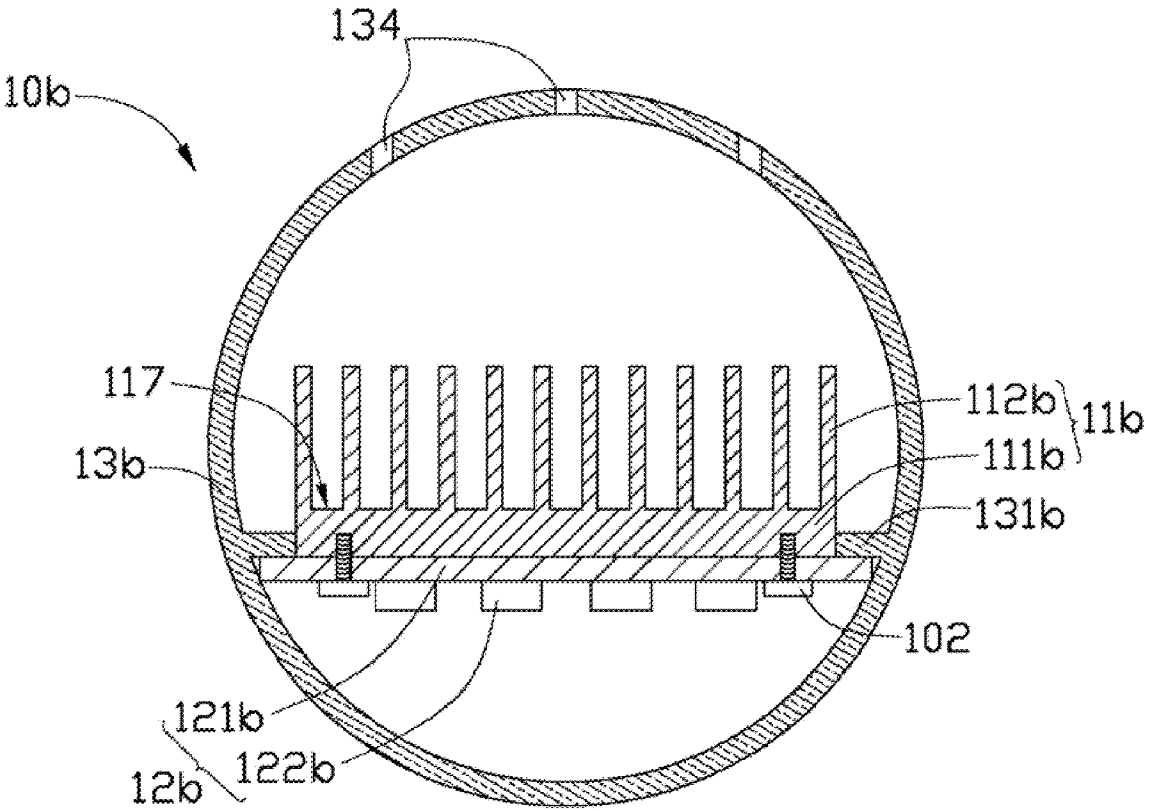
FIG. 8 is view similar to FIG. 2, but shows a lamp tube of an LED lamp according to a third embodiment.

Referring to FIG. 8, a cross section of a lamp tube 10*b* of an LED lamp according to a third embodiment is shown. In this embodiment, the lamp tube 10*b* includes a cooling member 11*b* being a fin-type heat sink which includes a heat absorbing plate 111*b* attached to a substrate 121*b* of a light source 12*b* and a plurality of fins 112*b* extending from the heat absorbing plate 111*b*. Screws 102 extend through the substrate 121*b* into the heat absorbing plate 111*b* to assemble the light source 12*b* and the cooling member 11*b* together. The lamp cover 13*b* is cylindrical-shaped, and receives the cooling member 11*b* and the light source 12*b* therein. A pair of protrusions 131*b* extend inwardly from an inner circumferential surface of the lamp cover 13*b*. Two opposite lateral edges of the substrate 121*b* each are locked between the inner circumferential surface of the lamp cover 13*b* and one corresponding protrusion 131*b*. A plurality of openings 134 are defined in the lamp cover 13*b* at a position over the fins 112*b* for dissipating heat from the lamp cover 13*b*.

Figure 9:
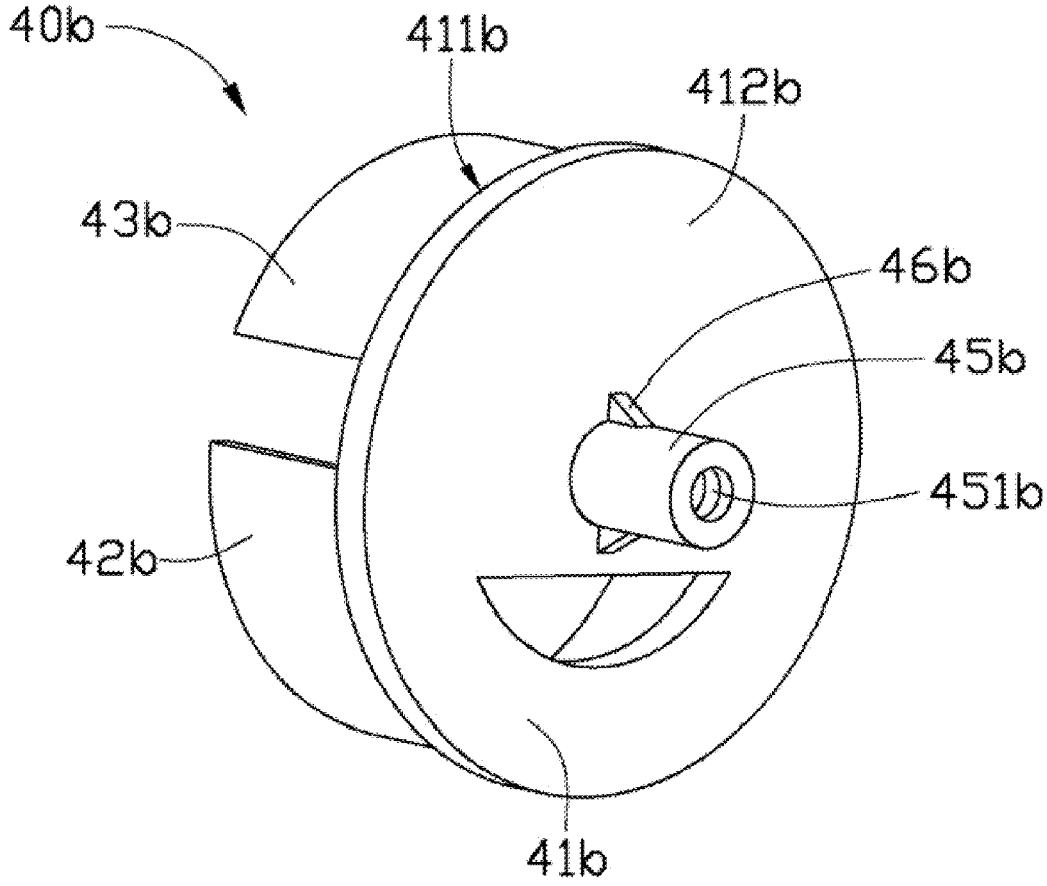
FIG. 9 is an isometric view of an end cap for the lamp tube of FIG. 8.
Figure 10:
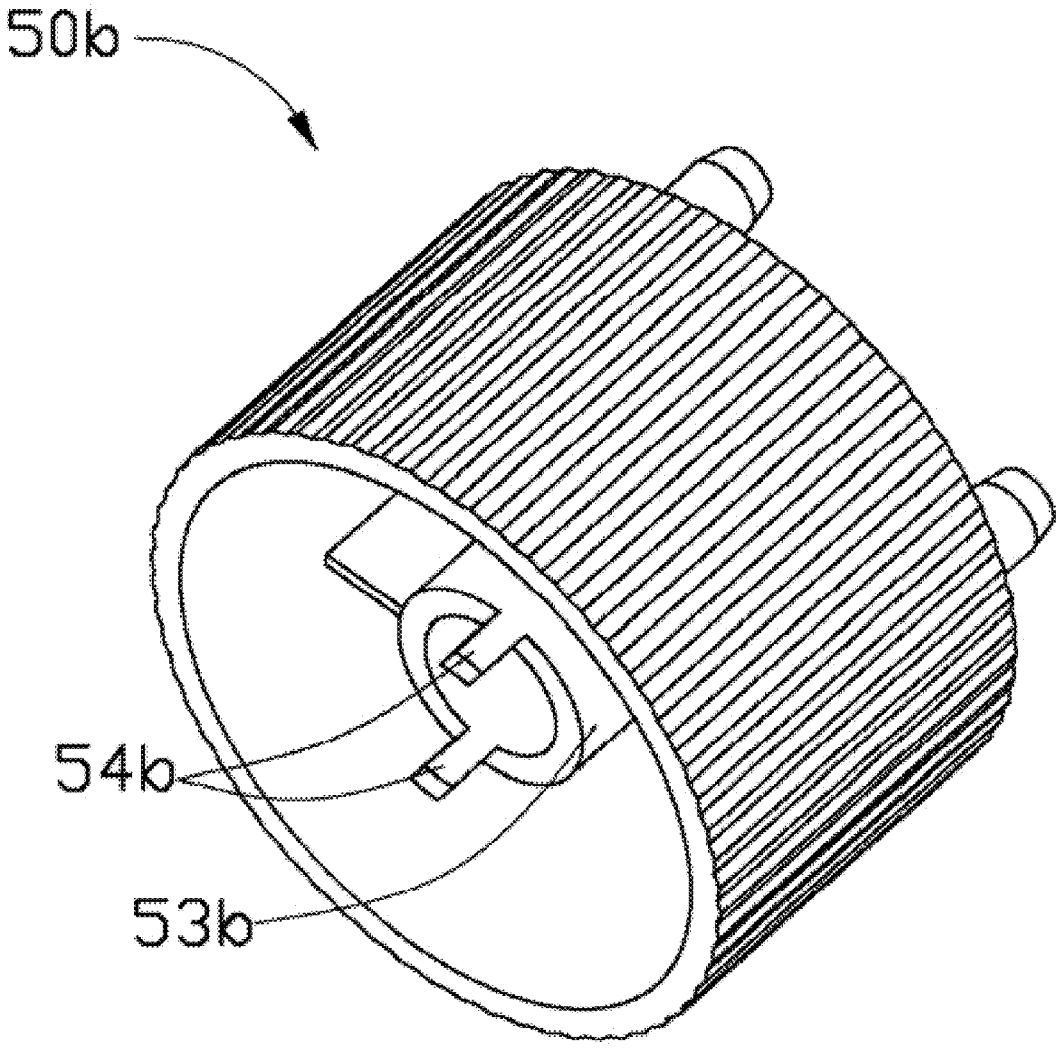
FIG. 10 is an isometric view of a connector for the end cap of FIG. 9.

Referring to FIGS. 9 and 10, a lamp cap for the lamp tube 10*b* of FIG. 8 includes an end cap 40*b* and a connector 50*b*. The end cap 40*b* includes a sealing plate 41*b*, upper and lower ears 43*b*, 42*b* formed on an inner surface 411*b* of the sealing plate 41*b*, and a pin 45*b* and a pair of blocks 46*b* formed on an outer surface 412*b* of the sealing plate 41*b*. In this embodiment, the upper and lower ears 43*b*, 42*b* both are arc-shaped, and thus both can be inserted into the lamp cover 13*b*. The pin 45*b* extends outwardly from a middle of the sealing plate 41*b*, and defines a threaded hole 451*b* therein. The blocks 46*b* are formed around the pin 45*b*, and are connected to an outer circumferential surface of the pin 45*b* and the outer surface 412*b* of the sealing plate 41*b*. Each of the blocks 46*b* has a shape of triangle.

The connector 50*b* has a seat 53*b* with an inner diameter substantially equaling to an outer diameter of the pin 45*b*. A pair of latches 54*b* extend outwardly from a free end of the seat 53*b*. Thus, when the connector 50*b* is assembled with the end cap 40*b*, the pin 45*b* is inserted into the seat 53*b* and the latches 54*b* are located between the blocks 46*b*. Therefore, the end cap 40*b* can be rotated relative to the connector 50*b* within an angle of 180 degrees.

Figure 11:
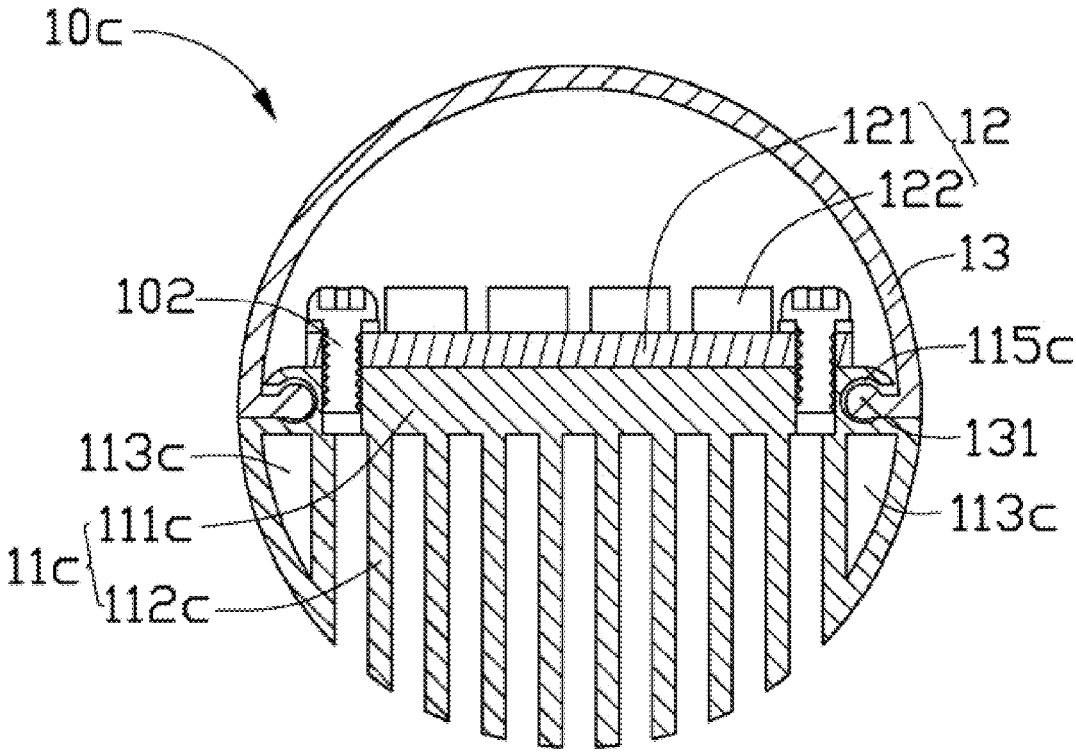
FIG. 11 is a view similar to FIG. 2, but shows a lamp tube of an LED lamp according to a fourth embodiment.

Referring to FIG. 11, a lamp tube 10*c* of an LED lamp according to a fourth embodiment is illustrated. The difference between this LED lamp and the LED lamp 100 of the first embodiment is the cooling member 11*c*. In this embodiment, the cooling member 11*c* includes a heat absorbing plate 111*c* and a plurality of fins 112*c* extending from the heat absorbing plate 111*c*. The heat absorbing plate 111*c* defines a pair of receiving grooves 115*c* receiving the protrusions 131 of the lamp cover 13 to assemble the cooling member 11*c* and the lamp cover 13 together. The fins 112*c* of the cooling member 11*c* cooperatively form a curved outer end. Two outmost fins 112*c* each are curved, and have a free end connected to an adjacent fin 112*c* to form a space 113*c* therebetween.

Figure 12:
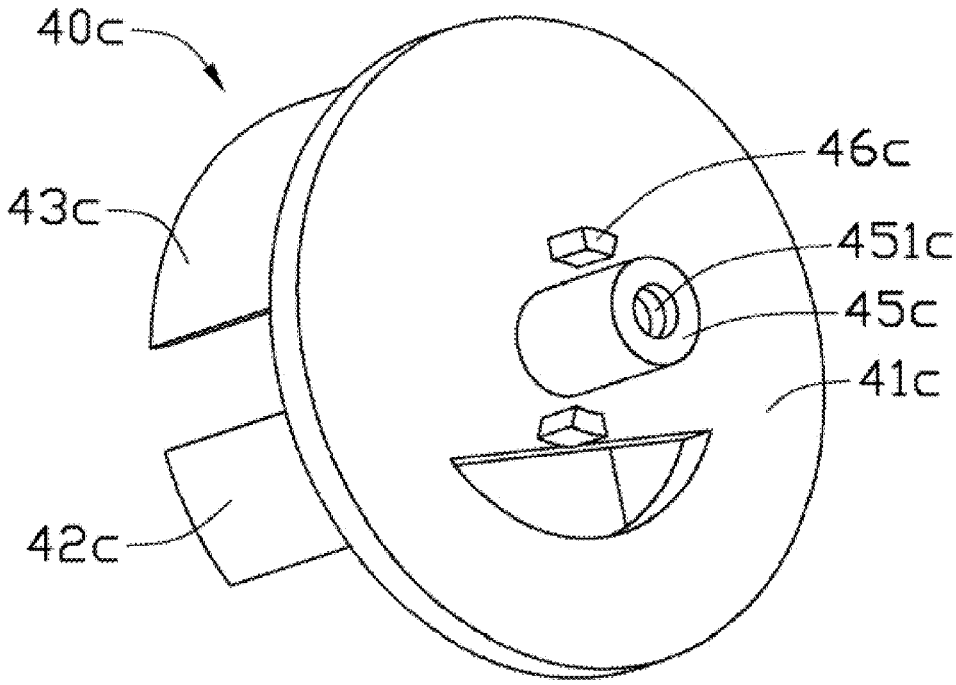
FIG. 12 is an isometric view of an end cap for the lamp tube of FIG. 11.

Referring to FIG. 12, an end cap 40*c* for the LED lamp of FIG. 11 includes a sealing plate 41*c*, upper and lower ears 43*c*, 42*c*, a pin 45*c* and a pair of blocks 46*c*. The upper ear 43*c* is arc-shaped for inserting into the lamp cover 13. The lower ear 42*c* includes a pair of curved elements for respectively inserting into the spaces 113*c* of the cooling member 11*c*. The pin 45*c* is formed at a middle of the sealing plate 41*c*, and defines a threaded hole 451*c* therein. The blocks 46*c* are spaced equally from the pin 45*c* and located at two opposite sides of the pin 45*c*.

Figure 13:
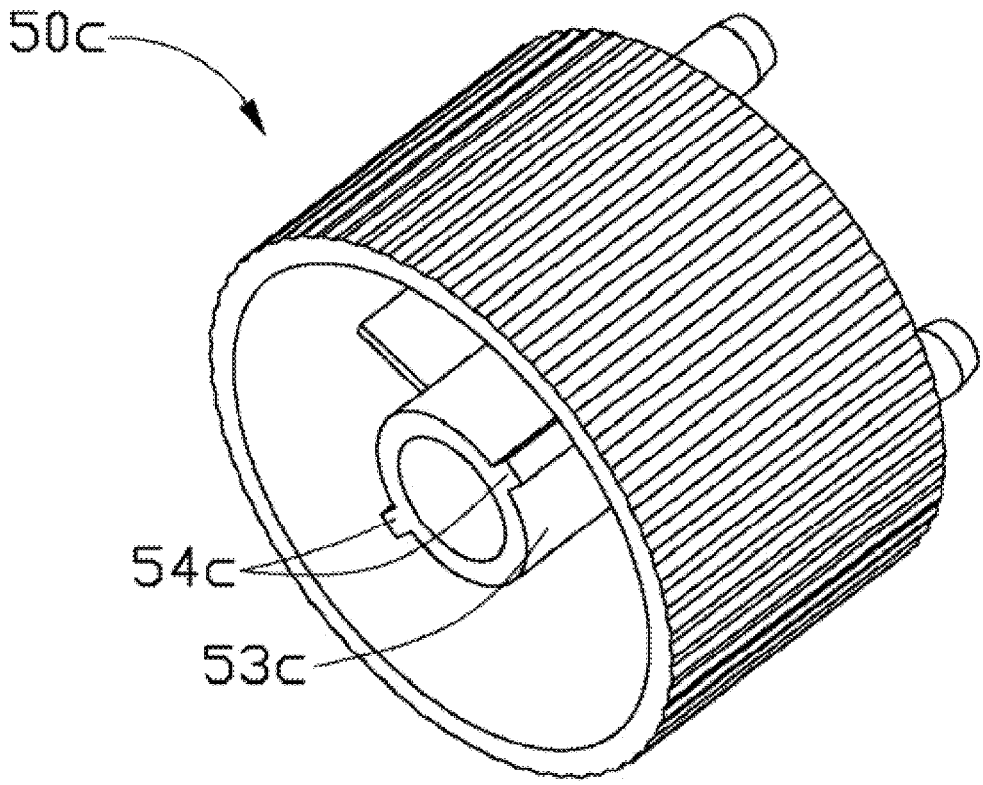
FIG. 13 is an isometric view of a connector for the end cap of FIG. 12.

Referring to FIG. 13, a connector 50*c* for this end cap 40*c* includes a seat 53*c*, and a pair of latches 54*c*. The seat 53*c* has an inner diameter not smaller than an outer diameter of the pin 45*c*. The latches 54*c* are symmetrically formed on an outer circumferential surface of the seat 53*c*. After the connector 50*c* is rotatably assembled with the end cap 40*c*, the latches 54*c* and the blocks 46*c* are located on a common circle, and the connector 50*c* is limited to rotate relative to the end cap 40*c* in a range of less than 180 degrees.

Figure 14:
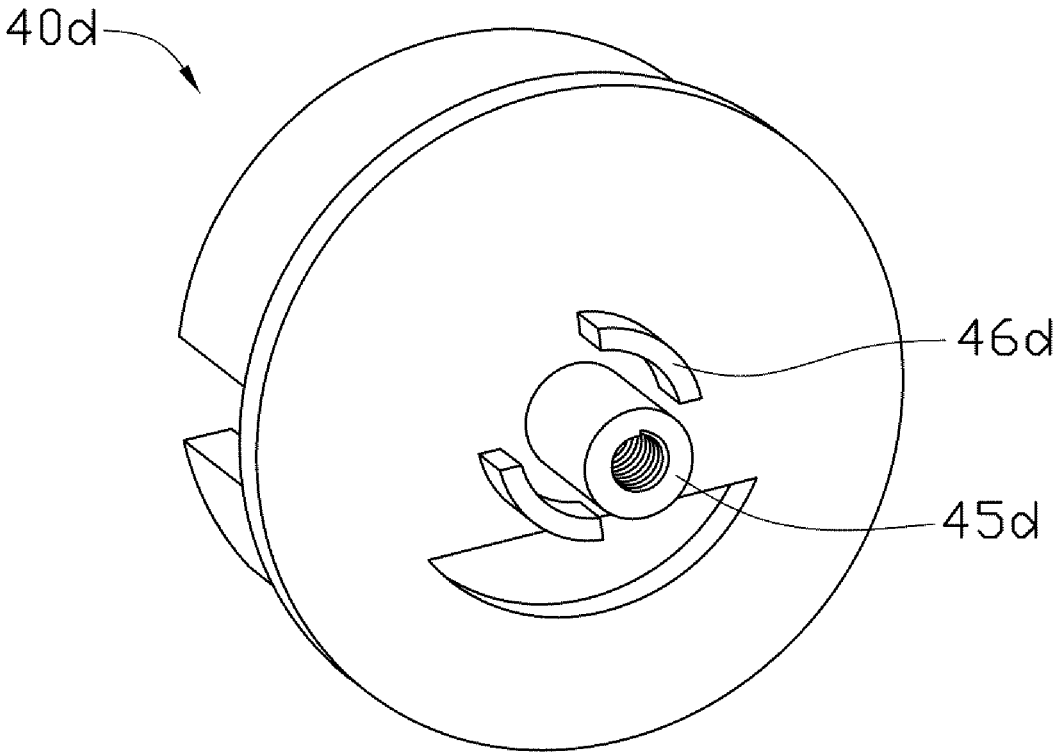
FIG. 14 shows an alternative end cap for the lamp tube of FIG. 11.
Figure 15:
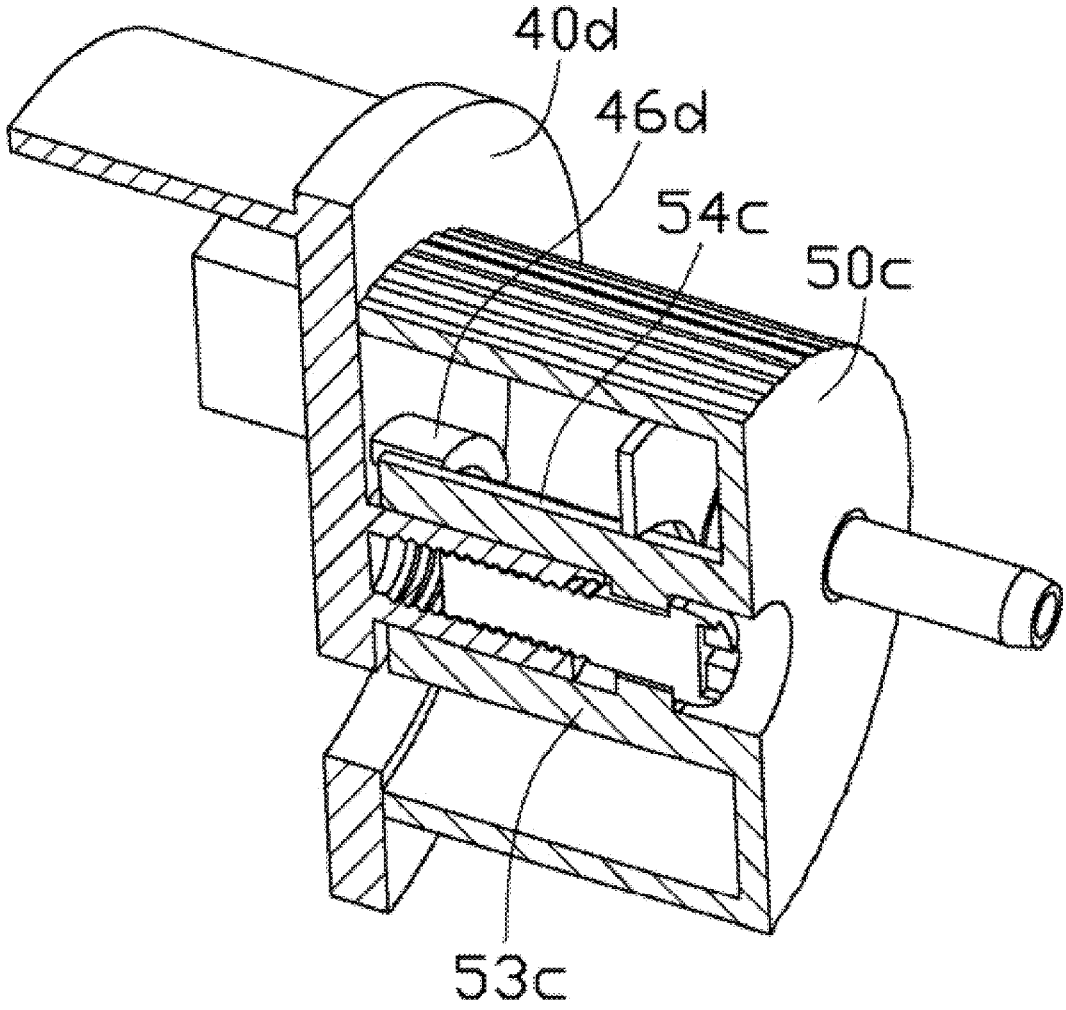
FIG. 15 is an axially cross-sectional view showing the end cap of FIG. 14 assembled with the connector of FIG. 13.
Figure 16:
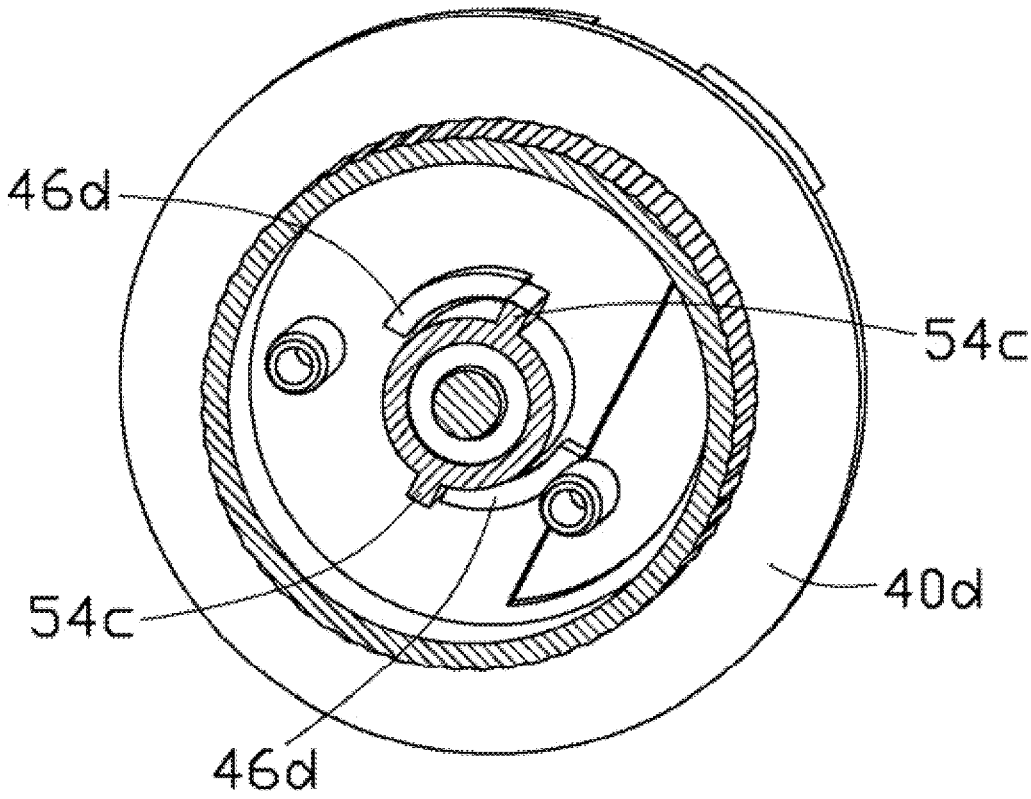
FIG. 16 is a radially cross-sectional view showing the end cap of FIG. 14 assembled with the connector of FIG. 13.

Referring to FIG. 14, an alternative end cap 40*d* is shown. This end cap 40*d* also can be assembled to the connector 50*c* shown in FIG. 13 to form a lamp cap. The difference between this end cap 40*d* and the end cap 40*c* shown in FIG. 12 is only in the blocks 46*d*. Referring to FIGS. 15 and 16 simultaneously, in this embodiment, the blocks 46*d* each are arc-shaped and have a width greater than the blocks 46*c* in a circumferential direction, and thus the angle defined between the blocks 46*d* relative to the pin 45*d* is about 90 degrees. In other words, a rotation angle of the lamp tube 10*c* relative to the connector 50*c* is about 90 degrees after the lamp tube 10*c* is assembled with the end caps 40*d* and the connectors 50*c*, which is much smaller than 180 degrees provided by the previous embodiment.

Figure 17:
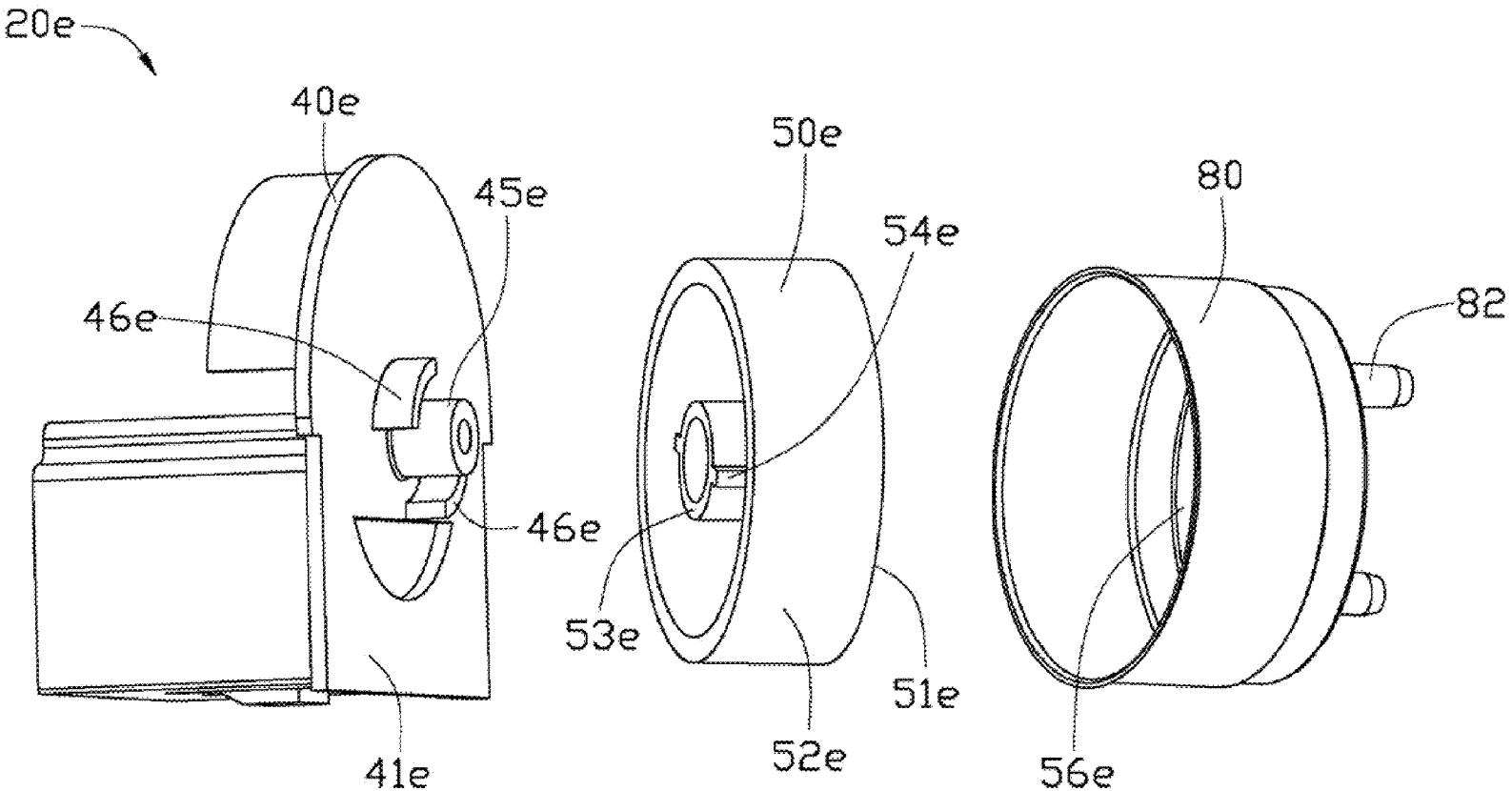
FIG. 17 is an isometric, exploded view of a lamp cap of an LED lamp according to a fifth embodiment.

FIG. 17 shows a lamp cap 20*e* according to a fifth embodiment. The difference between this embodiment and the first embodiment is the connector. In this embodiment, the connector includes a connecting element 50*e* and a shell 80. The connecting element 50*e* includes a circular base 51*e* and a cylinder 52*e* extending from an outer periphery of the base 51*e* to the sealing plate 41*e* of the end cap 40*e*. A seat 53*e* extends from the base 51*e* into the cylinder 52*e*. The seat 53*e* has an inner diameter not smaller than an outer diameter of the pin 45*e* of the end cap 40*e*. A pair of latches 54*e* are formed on an outer circumferential surface of the seat 53*e* corresponding to the blocks 46*e* of the end cap 40*e*. The shell 80 is mounted around the connecting element 50*e*. A pair of poles 82 extend outwardly from the shell 80 for connecting to the lamp holder. A conductive ring 56*e* is arranged in the shell 80 and electrically connected with the poles 82 for connecting the LEDs 122 to the lamp holder to get a power. The shell 80 can be a standard component, which can further facilitate assembly of the LED lamp.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp, comprising:

a cooling member comprising an elongated heat absorbing plate forming a heat absorbing surface at one outer side thereof;

a light source comprising a plurality of LEDs arranged on the heat absorbing surface of the heat absorbing plate;

a lamp cover covering the LEDs therein and engaged with the cooling member; and a pair of adjustable lamp caps arranged at opposite ends of the cooling member, each of the lamp caps comprising an end cap fixed on the cooling member and the lamp cover and a connector rotatably connected with the end cap, the connector comprising a pair of poles being electrically connected to the LEDs and extending outwardly therefrom adapted for inserting into a lamp holder to get a power for the LEDs.

2. The LED lamp of claim 1, wherein a pair of blocks are formed on the end cap facing the connector, and a pair of latches are formed on the connector, the blocks and the latches being located at a common circle, and being in an alternating fashion.

3. The LED lamp of claim 2, wherein an angle between the blocks relative to a center of the common circle is smaller than 180 degrees.

4. The LED lamp of claim 3, wherein the angle between the blocks relative to the center of the common circle is about 90 degrees.

5. The LED lamp of claim 2, wherein the end cap comprises a sealing plate, the sealing plate having an inner surface attached to the cooling member and the lamp cover and an outer surface attached to the connector, a pin extending from the outer surface towards the connector, the blocks surrounding the pin, the connector comprising a base and a cylinder extending from the base to abut the outer surface of the sealing plate of the end cap, the pin and the blocks being received in the cylinder, a seat extending from the base into the cylinder, the seat of the connector being rotatably connected with the pin of the end cap.

6. The LED lamp of claim 5, wherein the latches of the connector are formed on an inner circumference surface of the cylinder.

7. The LED lamp of claim 5, wherein the latches of the connector are formed on an outer circumference of the seat, the pin being inserted into the seat, the blocks being spaced from the pin.

8. The LED lamp of claim 5, wherein the latches of the connector are formed on an end surface of the seat, the pin being inserted into the seat, the blocks being connected with an outer circumferential surface of the pin.

9. The LED lamp of claim 5, wherein the connector further comprises a conductive ring mounted around the seat and connected to the poles, an aperture extending through the sealing plate for wires extending therethrough to interconnect the LEDs with the conductive ring.

10. The LED lamp of claim 5, wherein the connector further comprises a shell mounted around the cylinder, the poles extending from the shell, a conductive ring being received in the shell and connected with the poles.

11. The LED lamp of claim 1, wherein the end cap further comprises an upper ear extending from the inner surface thereof into the lamp cover, and a lower ear extending from the inner surface into the cooling member.

12. The LED lamp of claim 1, wherein the cooling member is rectangular and hollow, further comprising a generally U-shaped dissipating plate extending from the heat absorbing plate, a chamber being defined in the cooling member receiving a circuit board therein, the circuit board interconnecting the LEDs and the poles of the connector.

13. The LED lamp of claim 1, wherein the lamp cover is cylindrical-shaped and hollow, the cooling member and the LEDs being received in the lamp cover, the cooling member further comprising a plurality of fins extending from the heat absorbing plate.

14. The LED lamp of claim 1, wherein the heat absorbing plate of the cooling member defines a pair of receiving grooves in opposite edges thereof for receiving protrusions formed on the lamp cover.

15. An adjustable lamp cap, comprising:

an end cap comprising a sealing plate and a pin extending perpendicularly from the sealing plate;

a connector comprising a base, a cylinder extending from an outer periphery of the base, and a seat extending from a central portion of the base into the cylinder, the seat of the connector being rotatably connected to the pin of the end cap; and a pair of poles extending outwardly from the connector for inserting into a lamp holder.

16. The lamp cap of claim 15, wherein a pair of blocks are formed on the end cap facing the connector, and a pair of latches are formed on the connector, the blocks and the latches being located at a common circle, and being in an alternating fashion.

17. The lamp cap of claim 16, wherein the latches of the connector are formed on an inner circumference surface of the cylinder.

18. The lamp cap of claim 16, wherein the latches of the connector are formed on an outer circumference of the seat, the pin being inserted into the seat, the blocks being spaced from the pin.

19. The lamp cap of claim 16, wherein the latches of the connector are formed on an end surface of the seat, the pin being inserted into the seat, the blocks being connected with an outer circumferential surface of the pin.

20. The lamp cap of claim 16, wherein the connector further comprises a shell mounted around the cylinder, the poles extending from the shell, a conductive plate being arranged in the shell and connected to the poles electrically.

* * * * *